US005827630A

United States Patent [19]

Eichorst et al.

[11] Patent Number: 5,827,630

[45] Date of Patent: Oct. 27, 1998

[54] IMAGING ELEMENT COMPRISING AN ELECTRICALLY-CONDUCTIVE LAYER CONTAINING METAL ANTIMONATE AND NON-CONDUCTIVE METAL-CONTAINING COLLOIDAL PARTICLES AND A TRANSPARENT MAGNETIC RECORDING LAYER

[75] Inventors: Dennis J. Eichorst, Fairport; Paul A. Christian, Pittsford; Sharon M. Melpolder, Hilton, all of N.Y.

[73] Assignee: Eastman Kodak Company, Rochester, N.Y.

[21] Appl. No.: 970,130

[22] Filed: Nov. 13, 1997

[51] Int. Cl.[6] ..... G03C 1/85; G03C 1/89; G03C 5/10

[52] U.S. Cl. ..... 430/63; 430/69; 430/527; 430/533

[58] Field of Search ..... 430/527, 530, 430/69, 63

[56] References Cited

U.S. PATENT DOCUMENTS

| | | | |
|---|---|---|---|
| 3,525,621 | 8/1970 | Miller | 430/527 |
| 3,782,947 | 1/1974 | Krall | 430/140 |
| 4,203,769 | 5/1980 | Guestaux | 430/527 |
| 4,275,103 | 6/1981 | Tsubusaki et al. | 430/67 |
| 4,279,945 | 7/1981 | Audran et al. | 430/140 |
| 4,302,523 | 11/1981 | Audran et al. | 430/140 |
| 4,394,441 | 7/1983 | Kawaguchi et al. | 430/524 |
| 4,416,936 | 11/1983 | Erickson et al. | 428/286 |
| 4,416,963 | 11/1983 | Takimoto et al. | 430/69 |
| 4,418,141 | 11/1983 | Kawaguchi et al. | 430/530 |
| 4,431,764 | 2/1984 | Yoshizumi | 524/409 |
| 4,495,276 | 1/1985 | Takimoto et al. | 430/530 |
| 4,571,361 | 2/1986 | Kawaguchi et al. | 428/328 |
| 4,571,365 | 2/1986 | Ashlock et al. | 428/412 |
| 4,990,276 | 2/1991 | Bishop et al. | 252/62.54 |
| 4,999,276 | 3/1991 | Kuwabara et al. | 430/527 |
| 5,006,451 | 4/1991 | Anderson et al. | 430/527 |
| 5,024,826 | 6/1991 | Linton | 423/335 |
| 5,028,580 | 7/1991 | Shimomura et al. | 503/207 |
| 5,122,445 | 6/1992 | Ishigaki | 430/530 |
| 5,147,768 | 9/1992 | Sakakibara | 430/140 |
| 5,204,219 | 4/1993 | Van Ooij et al. | 430/523 |
| 5,215,874 | 6/1993 | Sakakibara | 430/501 |
| 5,217,804 | 6/1993 | James et al. | 428/329 |
| 5,221,598 | 6/1993 | Anderson et al. | 430/527 |
| 5,229,259 | 7/1993 | Yokota | 430/140 |
| 5,236,737 | 8/1993 | Linton | 427/126.3 |
| 5,236,818 | 8/1993 | Carlson | 430/527 |
| 5,284,714 | 2/1994 | Anderson et al. | 430/527 |
| 5,294,525 | 3/1994 | Yamauchi et al. | 430/530 |
| 5,336,589 | 8/1994 | Mukunoki et al. | 430/501 |
| 5,344,751 | 9/1994 | Carlson | 430/527 |
| 5,360,706 | 11/1994 | Anderson et al. | 430/530 |
| 5,366,855 | 11/1994 | Anderson et al. | 430/530 |
| 5,368,995 | 11/1994 | Christian et al. | 430/530 |
| 5,380,584 | 1/1995 | Anderson et al. | 430/324 |
| 5,382,494 | 1/1995 | Kudo et al. | 430/527 |
| 5,413,900 | 5/1995 | Yokota | 430/140 |
| 5,427,835 | 6/1995 | Morrison et al. | 430/527 |
| 5,439,785 | 8/1995 | Boston et al. | 430/530 |
| 5,459,021 | 10/1995 | Ito et al. | 430/527 |
| 5,545,250 | 8/1996 | Bergmann et al. | 75/252 |
| 5,576,163 | 11/1996 | Anderson et al. | 430/530 |
| 5,582,959 | 12/1996 | Ito | 430/527 |

FOREIGN PATENT DOCUMENTS

| | | |
|---|---|---|
| 0 250 154 | 12/1987 | European Pat. Off. . |
| 0 301 827 B1 | 7/1988 | European Pat. Off. . |
| 0 531 006 A1 | 3/1993 | European Pat. Off. . |
| 0 618 489 A1 | 10/1994 | European Pat. Off. . |
| 0 657 774 A1 | 6/1995 | European Pat. Off. . |
| 4-055492 | 2/1992 | Japan . |
| 4-062543 | 2/1992 | Japan . |
| 6-161033 | 6/1994 | Japan . |
| 7-168293 | 7/1995 | Japan . |

*Primary Examiner*—Richard L. Schilling
*Attorney, Agent, or Firm*—Carl F. Ruoff

[57] ABSTRACT

The present invention is a multilayer imaging element which includes a support, at least one image-forming layer, a transparent magnetic layer and a transparent electrically-conductive layer. The transparent magnetic layer includes magnetic particles dispersed in a film forming binder. The transparent electrically-conductive layer includes electronically-conductive metal antimonate colloidal particles having a particle size of from 0.005 to 0.05 $\mu$m and non- conductive metal-containing colloidal particles having a particle size of from 0.002 to 0.05 $\mu$m dispersed in a film-forming binder.

26 Claims, No Drawings

IMAGING ELEMENT COMPRISING AN ELECTRICALLY-CONDUCTIVE LAYER CONTAINING METAL ANTIMONATE AND NON-CONDUCTIVE METAL-CONTAINING COLLOIDAL PARTICLES AND A TRANSPARENT MAGNETIC RECORDING LAYER

CROSS REFERENCE TO RELATED APPLICATIONS

This application relates to commonly assigned copending application Ser. No. 08/969,393, filed simultaneously herewith and hereby incorporated by reference for all that it discloses.

FIELD OF THE INVENTION

This invention relates generally to imaging elements and in particular, to imaging elements comprising a support, at least one image-forming layer, at least one transparent, electrically-conductive layer, and a transparent magnetic recording layer. More specifically, this invention relates to photographic and thermally-processable imaging elements comprising one or more sensitized imaging layers and a transparent magnetic recording layer in combination with one or more electrically-conductive layers containing an intimate mixture of at least one type of an electrically-conductive colloidal metal antimonate particle and at least one type of a non-conductive, metal-containing filler particle of comparable or smaller size, both dispersed in a film-forming binder or mixture of film-forming binders, which can provide protection for such imaging elements against the accumulation and discharge of electrostatic charge or serve as a transparent electrode in an image-forming process.

BACKGROUND OF THE INVENTION

It is well known to include in various kinds of imaging elements, a transparent layer containing magnetic particles dispersed in a polymeric binder. The inclusion and use of such transparent magnetic recording layers in light-sensitive silver halide photographic elements has been described in U.S. Pat. Nos. 3,782,947; 4,279,945; 4,302,523; 4,990,276; 5,215,874; 5,217,804; 5,229,259; 5,252,441; 5,254,449; 5,335,589; 5,395,743; 5,413,900; 5,427,900; 5,498,512; and others. Such elements are advantageous because images can be recorded by customary photographic processes while information can be recorded simultaneously into or read from the magnetic recording layer by techniques similar to those employed for traditional magnetic recording art.

A difficulty, however, arises in that magnetic recording layers generally employed by the magnetic recording industry are opaque, not only because of the nature of the magnetic particles, but also because of the requirements that these layers contain other addenda which further influence the optical properties of the layer. Also, the requirements for recording and reading of the magnetic signal from a transparent magnetic layer are more stringent than for conventional magnetic recording media because of the extremely low coverage of magnetic particles required to ensure transparency of the transparent magnetic layer as well as the fundamental nature of the photographic element itself. Further, the presence of the magnetic recording layer cannot interfere with the function of the photographic imaging element.

Any such transparent magnetic recording layer must be capable of accurate recording and playback of digitally encoded information repeatedly on demand by various devices such as a camera or a photofinishing or printing system. The layer also must exhibit excellent runnability, durability (i.e., abrasion and scratch resistance), and magnetic head-cleaning properties without adversely affecting the imaging quality of the photographic elements. However, this goal is extremely difficult to achieve because of the nature and concentration of the magnetic particles required to provide sufficient signal to write and read magnetically stored data and the effect of any noticeable color, haze or grain associated with the magnetic layer on the optical density and granularity of the photographic layers. These goals are particularly difficult to achieve when magnetically recorded information is stored and read from the photographic image area. Further, because of the curl of the photographic element, primarily due to the photographic layers and the core set of the support, the magnetic layer must be held more tightly against the magnetic heads than in conventional magnetic recording in order to maintain planarity at the head-media interface during recording and playback operations. Thus, all of these various characteristics must be considered both independently and cumulatively in order to arrive at a commercially viable photographic element containing a transparent magnetic recording layer that will not have a detrimental effect on the photographic imaging performance and still withstand repeated and numerous read-write operations by a magnetic head.

Problems associated with the generation and discharge of electrostatic charge during the manufacture and use of photographic film and paper have been recognized for many years by the photographic industry. The accumulation of charge on film or paper surfaces can cause difficulties in support conveyance as well as lead to the attraction of dust, which can produce fog, desensitization, repellency spots during emulsion coating, and other physical defects. The discharge of accumulated static charge during or after the application of the sensitized emulsion layer(s) can produce irregular fog patterns or static marks in the emulsion. The severity of the static problems has been exacerbated greatly by increases in sensitivity of new emulsions, increases in coating machine speeds, and increases in post-coating drying efficiency. The charge generated during the coating process results primarily from the tendency of webs of high dielectric constant polymeric film base to undergo triboelectric charging during winding and unwinding operations, during conveyance through the coating machines, and during post-coating operations such as slitting, perforating, and spooling. Static charge can also be generated during the use of the finished photographic product. In an automatic camera, because of the repeated motion of the photographic film in and out of the film cassette, there is the added problem of the generation of electrostatic charge by the movement of the film across the magnetic heads and by the repeated winding and unwinding operations, especially in a low relative humidity environment. The accumulation of charge on the film surface results in the attraction and adhesion of dust to the film. The presence of dust not only can result in the introduction of physical defects and the degradation of the image quality of the photographic element but also can result in the introduction of noise and the degradation of magnetic recording performance (e.g., decreased S/N ratio, "drop-outs", etc.). This degradation of magnetic recording performance can arise from various sources including signal loss resulting from increased head-media spacing, electrical noise caused by discharge of the static charge by the magnetic head during playback, uneven film transport across the magnetic heads, clogging of the magnetic head gap, and excessive wear of the magnetic heads. In order to prevent these problems arising from triboelectric charging, there are various well known methods by which an electrically-conductive layer can be introduced into the photographic element to dissipate any accumulated electrostatic charge.

An electrically-conductive layer can be incorporated in an imaging element in various ways to dissipate accumulated static charge, for example, as a subbing layer, an intermediate layer or interlayer, and especially as an outermost layer either overlying the imaging layer or as a backing layer on the opposite side of the support from the imaging layer(s). Typically, in photographic elements of prior art containing a transparent magnetic recording layer, the antistatic layer was preferably present as a backing layer underlying the magnetic recording layer. A wide variety of conductive antistatic agents can be used in antistatic layers to produce a broad range of surface electrical conductivities. Many of the traditional antistatic layers of prior art used in imaging elements employ electrically-conductive materials which exhibit predominantly ionic conductivity, for example, simple inorganic salts, alkali metal salts of surfactants, alkali metal ion-stabilized colloidal metal oxide sols, ionic conductive polymers or polymeric electrolytes containing alkali metal salts, and the like. The conductivities of such ionic conductors are typically strongly dependent on the temperature and relative humidity of their environment. At low relative humidities and temperatures, the diffusional mobilities of the charge-carrying ions are greatly reduced and the bulk electrical conductivity is substantially decreased. At high relative humidities, an unprotected antistatic backing layer containing such an ionic conductor can absorb water, swell, and soften. Especially in the case of photographic roll films, this can result in the adhesion (viz., ferrotyping) and even physical transfer of portions of a backing layer to a surface layer on the emulsion side of the film (viz., blocking).

Antistatic layers containing electronic conductors such as conjugated conductive polymers, conductive carbon particles or fibers, metallic particles or fibers, crystalline semiconductor particles, amorphous semiconductive fibrils, and continuous semiconductive thin films can be used more effectively than ionic conductors to dissipate static charge since their electrical conductivity is independent of relative humidity and only slightly influenced by ambient temperature. Of the various types of electronic conductors, electrically-conductive metal-containing particles, such as semiconductive metal oxides, when dispersed with suitable polymeric film-forming binders, are particularly effective for use in transparent conductive layers. Binary metal oxides doped with appropriate donor heteroatoms or containing oxygen deficiencies have been disclosed in prior art to be useful in antistatic layers for photographic elements, for example: U.S. Pat. Nos. 4,275,103; 4,416,963; 4,495,276; 4,394,441; 4,418,141; 4,431,764; 4,495,276; 4,571,361; 4,999,276; 5,122,445; 5,294,525; 5,382,494; 5,459,021; and others. Suitable claimed conductive metal oxides include: zinc oxide, titania, tin oxide, alumina, indium oxide, silica, magnesia, zirconia, barium oxide, molybdenum trioxide, tungsten trioxide, and vanadium pentoxide. Preferred doped conductive metal oxide granular particles include Sb-doped tin oxide, Al- doped zinc oxide, and Nb-doped titania. Additional preferred conductive ternary metal oxides disclosed in U.S. Pat. Nos. 5,368,995 and 5,457,013 include zinc antimonate and indium antimonate. Other suitable conductive metal-containing granular particles including metal borides, carbides, nitrides, and silicides have been disclosed in Japanese Kokai No. JP 04-055,492.

The use of such electrically-conductive layers containing suitable semiconductive metal oxide particles dispersed in a film-forming binder in combination with a transparent magnetic recording layer in silver halide imaging elements has been described in the following examples of the prior art. Photographic elements comprising a transparent magnetic recording layer and a transparent electrically-conductive layer both located on the backside of the film base have been described in U.S. Pat. Nos. 5,147,768; 5,229,259; 5,294,525; 5,336,589; 5,382,494; 5,413,900; 5,457,013; 5,459,021; and others. The conductive layers described in these cited patents contain fine granular particles of a semiconductive crystalline metal oxide such as zinc oxide, titania, tin oxide, alumina, indium oxide, silica, complex or compound oxides thereof, and zinc or indium antimonate dispersed in a polymeric film-forming binder. Of these conductive metal oxides, antimony-doped tin oxide and zinc antimonate are preferred. A granular, antimony-doped tin oxide particle commercially available from Ishihara Sangyo Kaisha under the tradename "SN-100P" was disclosed as particularly preferred in Japanese Kokai Nos. 04-062543, 06-161033, and 07-168293. Surface electrical resistivity (SER) values were reported in U.S. Pat. No. 5,382,494 for conductive layers measured prior to overcoating with a transparent magnetic recording layer as ranging from $10^5$ to $10^7$ ohms/square and from $10^6$ to $10^8$ ohms/square after overcoating. Surface resistivity values of about $10^8$ to $10^{11}$ ohms/square for conductive layers overcoated with a transparent magnetic recording layer were reported in U.S. Pat. Nos. 5,457,013 and 5,459,021.

Antistatic backing or subbing layers containing colloidal amorphous vanadium pentoxide, especially silver-doped vanadium pentoxide, are described in U.S. Pat. Nos. 4,203,769 and 5,439,785. Colloidal vanadium pentoxide is composed of highly entangled microscopic fibrils or ribbons 0.005–0.01 $\mu$m wide, about 0.001 $\mu$m thick, and 0.1–1 $\mu$m in length. However, colloidal vanadium pentoxide is soluble at the high pH typical of developer solutions for photographic processing and must be protected by a nonpermeable barrier layer as taught in U.S. Pat. Nos. 5,006,451; 5,221,598; 5,284,714; and 5,366,855, for example. Alternatively, a film-forming sulfopolyester latex or polyesterionomer binder can be combined with the colloidal vanadium pentoxide in the conductive layer to minimize degradation during processing as taught in U.S. Pat. Nos. 5,360,706; 5,380,584; 5,427,835; 5,576,163; and others. Further, when a conductive layer containing colloidal vanadium pentoxide underlies a transparent magnetic recording layer that is free from reinforcing filler particles, the magnetic layer inherently can serve as a nonpermeable barrier layer. However, if the magnetic recording layer contains reinforcing filler particles, such as γ-aluminum oxide or silica fine particles, it must be crosslinked using suitable cross-linking agents in order to preserve the desired barrier properties, as taught in U.S. Pat. No. 5,432,050. The use of colloidal vanadium pentoxide dispersed with either a copolymer of vinylidene chloride, acrylonitrile, and acrylic acid or with an aqueous dispersible polyester coated on subbed polyester supports and overcoated with a transparent magnetic recording layer is taught in U.S. Pat. No. 5,514,528. The use of an aqueous dispersible polyurethane or polyesterionomer binder with colloidal vanadium pentoxide in a conductive subbing layer underlying a solvent-coated transparent magnetic layer is taught in copending commonly assigned U.S. Pat. Ser. No. 08/662,188, filed Jun., 1996.

The use of non-conductive "auxilliary" fine particles such as binary metal oxides (e.g., ZnO, $TiO_2$, $SiO_2$, $Al_2O_3$, MgO, BaO, $WO_3$, $MoO_3$, $ZrO_2$, $P_2O_5$), kaolin, talc, mica, alkaline earth sulfates (e.g., $BaSO_4$, $SrSO_4$, $CaSO_4$, $MgSO_4$) or alkaline earth carbonates (e.g., $CaCO_3$, $MgCO_3$) as grinding aids in the preparation of electrically-conductive layers containing conductive metal oxide particles for use in photographic elements has been disclosed in U.S. Pat. Nos. 4,416,963; 4,495,276; 5,028,580, and 5,582,959. It was claimed in the '580 patent that "fine grains" of a crystalline non-conductive metal oxide which does not contribute directly to improving conductivity can be added to a backing layer for a thermal recording imaging element. It was further disclosed in the '580 patent that it was particularly advantageous to remove a greater part of any such auxilliary particles by physical (e.g., filtration, centrifugation, etc.) or chemical (e.g., dissolution) treatments after preparing dispersions of the conductive metal oxide particles and before preparing coated layers.

Colloidal silica in the form of an aqueous sol consisting of silica particles with a high specific surface area can be used in combination with a soluble alkylaryl polyether sulphonate to provide conductive backing layers for photographic paper as disclosed in U.S. Pat. No. 3,525,621. However, such conductive layers exhibit unsuitably low levels of conductivity after photographic processing because of the solubility of the alkylaryl polyether sulphonate in the photographic processing solutions.

The use of colloidal non-conductive metal oxide particles combined with an optional film-forming polymeric binder to prepare conductive layers for photographic elements has been taught widely in prior art. For example, the preparation of conductive layers comprising a continuous gelled network of colloidal metal oxide particles on a photographic film or paper support is taught in European Application Nos. 250,154; 301,827; 531,006; 657,774. Preferred colloidal particles are disclosed to have an average diameter less than about 20 nm. The inclusion of an ambifunctional silane compound as a coupling agent in conductive layers containing colloidal metal oxide particles to improve adhesion to overlying gelatin-containing layers was claimed in U.S. Pat. No. 5,204,219. Preferred colloidal metal oxide particles claimed include silica, titania, and tin oxide, and mixtures thereof. Dispersions of such colloidal metal oxide particles are typically stabilized electrostatically by the presence of alkali metal or ammonium cations. The use of gelatin or a gelatin-compatible protein such as chitosan (i.e., a d-glucosamine) as a film-forming polymeric binder is taught in European Application Nos. 657,774 and 531,006, respectively. Coatings prepared in accordance with European Application No. 531,006 contain colloidal metal oxide particles at a particle to polymeric binder weight ratio of from 75:25 to 92:8 and exhibit surface resistivity values of $10^8$–$10^{10}$ log ohms/square at 40% R.H. which increased to $10^{10}$–$10^{11}$ log ohms/square after photographic processing. The addition of a water soluble alkali metal orthosilicate or metasilicate to a conductive layer containing a gelled network of colloidal metal oxide particles in order to improve cohesion as well as adhesion of the layer when overcoated with a gelatin-containing layer is taught in U.S. Pat. Nos. 5,236,818 and 5,344,751 and European Application No. 657,774.

The use of colloidal metal oxides in the presence of alkali metal ions, multifunctional silanes, and various ionic conductive polymers such as sodium styrenesulfonate/maleic acid copolymers in antistatic layers for photographic elements is disclosed in European Application No. 618,489. Preferred colloidal metal oxides include titania, silica, and alumina. Antistatic coatings were reported to exhibit surface resistivity values ranging from $10^6$–$10^{10}$ log ohms/square. However, no values were reported for such antistatic coatings after photographic processing. The use of colloidal metal oxide particles in combination with various organosilanes in transparent abrasion-resistant protective topcoatings for polymeric sheets or articles is disclosed in U.S. Pat. No. 4,571,365. The use of non-conductive colloidal metal oxides (e.g., alumina, antimony oxide) as well as conductive metal oxides (e.g., antimony-doped tin oxide, tin doped indium oxide, cadmium stannate) in such coatings was claimed. Use of conductive metal oxides was reported to improve static dissipating properties of the protective layers. However, the utility of such protective layers for imaging elements was neither disclosed nor anticipated.

A class of composite, electrically-conductive powders said to be useful for preparing conductive coatings, films, and other articles consisting of an intimate mixture of at least one type of electrically-conductive powder and at least one type of a particulate filler material which is nonconductive has been disclosed in U.S. Pat. No. 5,545,250. Such composite conductive powders preferably contain binary or ternary mixtures of the component powders. Further, the composite conductive powders are said to exhibit dry powder resistivity values which are lower than the weighted average of the dry powder resistivity values for the component powders. Suitable electrically-conductive component powders include crystalline antimony -doped tin oxide particles as well as composite conductive particles consisting of non-conductive core particles such as oxides of titanium, silicon, magnesium, calcium, barium, strontium, zinc, tin, nickel or iron; carbonates or sulfates of calcium, barium or strontium; mica, cordierite, anorthite, pyrophyllite, and the like, upon which an amorphous silica coating and a network of conductive crystallites (e.g., antimony-doped tin oxide, silver, gold, copper, nickel, etc.) are deposited sequentially. Specific methods for preparing such composite conductive particles have been described in detail in U.S. Pat. Nos. 5,024,826 and 5,236,737. Suitable non-conductive filler powders include amorphous silica, hollow silica shells, titania, mica, calcium carbonate, as well as the core particles used to prepare the composite conductive particles described hereinabove. The method used to prepare the composite electrically-conductive powders of the '250 Patent is described as essentially a relatively gentle dry blending procedure that is sufficient to provide intimate mixing of the individual component powders without degrading the electroconductive properties of the conductive component powders. Further, conductive coatings prepared using dispersions of composite conductive powders of the type taught in the '250 Patent having a film-forming binder in an aqueous vehicle are said to exhibit less color and higher optical transparency than such coatings containing equivalent amounts of the electrically-conductive component powders. However, the particles comprising the composite conductive powders as well as the conductive and non-conductive component particles taught in the '250 Patent are substantially too large to provide conductive layers with optical transparency and low haze properties suitable for use in photographic or thermally-processable imaging elements.

The use of colloidal, electrically-conductive metal antimonate particles (e.g., zinc antimonate) in antistatic layers for imaging elements, especially for silver halide-based photographic elements, is broadly claimed in U.S. Pat. No. 5,368,995. Further, the use of colloidal, conductive metal antimonate particles in antistatic layers used in combination with a transparent magnetic recording layer is taught in U.S. Pat. No. 5,457,013. However, dry weight coverages of metal antimonate in conductive subbing and backing layers sufficient to provide preferred levels of electrical conductivity for antistatic protection of imaging elements produce an undesirable increase in optical density because of absorption and haze due to scattering by agglomerates of particles. The requirements for low optical density, low haze, lack of photoactivity, and low manufacturing cost dictate that the conductive layer must be coated using as low a dry weight coverage of metal antimonate as possible. It is an objective of the present invention to provide transparent, conductive layers which deliver adequate antistatic protection as well as exhibit lower optical absorption and scattering losses than conductive layers containing metal antimonate particles of prior art. Futher, for the conductive layers disclosed in the '013 Patent containing less than about 85% zinc antimonate by weight, the internal resistivity of the conductive layer increased appreciably after overcoating with a transparent magnetic recording layer. Thus, another objective of this invention is to provide a conductive layer containing lower dry weight coverages of conductive metal antimonate particles which exhibits a minimal increase in electrical resistivity when overcoated with a transparent magnetic recording layer by a means other than increasing the amount of conductive metal antimonate in the conductive layer as taught in the '013 Patent.

Because the requirements for an electrically-conductive layer to be useful in an imaging element are extremely demanding, the art has long sought to develop improved conductive layers exhibiting a balance of the necessary chemical, physical, optical, and electrical properties. As indicated hereinabove, the prior art for providing electrically-conductive layers useful for imaging elements is extensive and a wide variety of suitable electroconductive materials have been disclosed. However, there is still a critical need for improved conductive layers which can be used in a wide variety of imaging elements, which can be manufactured at a reasonable cost, which are resistant to the effects of humidity change, which are durable and abrasion-resistant, which do not exhibit adverse sensitometric or photographic effects, which exhibit acceptable adhesion to overlying or underlying layers, which exhibit suitable cohesion, and which are substantially insoluble in solutions with which the imaging element comes in contact, such as processing solutions used for silver halide photographic elements. Furthermore, to provide both effective magnetic recording properties and effective electrical conductivity characteristics in an imaging element, without impairing its imaging characteristics, poses an even greater technical challenge. It is toward the objective of providing a combination of a transparent magnetic recording layer and an electrically-conductive layer that more effectively meet the diverse needs of imaging elements, especially those of silver halide photographic films, but also of a wide range of other types of imaging elements, than those of the prior art that the resent invention is directed.

SUMMARY OF THE INVENTION

The present invention is a multilayer imaging element which includes a support, at least one image-forming layer, a transparent magnetic layer and a transparent electrically-conductive layer. The transparent magnetic layer includes magnetic particles dispersed in a film forming binder. The transparent electrically-conductive layer includes electronically-conductive metal antimonate colloidal particles having a particle size of from 0.005 to 0.05 $\mu$m and non-conductive metal-containing colloidal particles having a particle size of from 0.002 to 0.05 $\mu$m dispersed in a film-forming binder.

DETAILED DESCRIPTION OF THE INVENTION

This invention provides an improved imaging element for use in an image-forming process containing a support, at least one image-forming layer, a transparent magnetic recording layer, and at least one transparent, electrically-conductive layer, wherein the electrically-conductive layer contains both colloidal particles of an electroconductive metal antimonate compound having a rutile or rutile-related crystal structure and colloidal, non-conductive, metal-containing filler particles of comparable or smaller size, one or more film-forming polymeric binders, and other optional additives. Imaging elements in accordance with this invention can be of many different types depending on the particular use for which they are intended. Such elements can include, for example, photographic, thermographic, electrothermographic, photothermographic, dielectric recording, dye migration, dye-ablation, thermal dye transfer, electrostatographic, electrophotographic, thermally-processable imaging elements, and others. Detailed descriptions of the structure and function of each of these imaging elements are provided in U.S. Pat. Nos. 5,368,995 and 5,457,013 assigned to the same assignee as the present Application and are incorporated herein by reference. The present invention can be practiced effectively in conjunction with any of the various imaging elements described therein as well as others known to those skilled in the art.

A wide variety of non-conductive metal-containing filler particles can be substituted for conductive metal antimonate particles. Suitable non-conductive inorganic filler particles include, for example, metal oxides, clays, proto-clays, clay-like minerals, zeolites, micas, and the like. Particularly suitable non-conductive inorganic filler particles include colloidal size (e.g., ~0.002–0.050 $\mu$m) particles of non-conductive tin oxide, zinc oxide, antimony pentoxide, zinc antimonate, silica, alumina-modified silica, various natural clays, synthetic clays, and the like. Such inorganic filler particles can be substituted for up to about 75% of the metal antimonate particles in a conductive layer without an appreciable decrease (i.e.,$\leqq$1 log ohms/square) in surface electrical conductivity of the conductive layer.

Imaging elements of this invention contain a transparent magnetic recording layer which can be used to record and store additional information by techniques similar to those employed in the magnetic recording art. Such a transparent magnetic recording layer can be positioned in an imaging element in any of various positions. For example, it can overlie one or more image-forming layers, underlie one or more image-forming layers, be interposed between image-forming layers, be coated on the side of the support opposite an image-forming layer as a backing layer or be contained within an image-forming layer.

Conductive layers in accordance with this invention are broadly applicable to photographic, electrophotographic, thermographic, photothermographic, electrothermographic, electrostatographic, dielectric recording, dye migration, dye ablation, thermal-dye-transfer imaging elements as well as other thermally-processable imaging elements, and are particularly useful for solution- processed silver halide imaging elements. Conductive layers of this invention may be present as backing, subbing, intermediate or protective overcoat layers on either or both sides of the support. Such layers are strongly adherent to the support and other underlying layers as well as to overlying layers such as pelloid, abrasion resistant, transport control, magnetic recording or imaging layers. Further, the electrical conductivity afforded by conductive layers of this invention is nearly independent of relative humidity, only slightly degraded when overcoated with a gelatin-containing pelloid, sensitized emulsion layer or transparent magnetic recording layer and persists nearly unchanged after photographic processing.

Photographic elements which can be provided with an electrically-conductive layer in accordance with this invention can differ widely in structure and composition. For example, they can vary greatly with regard to the type of support, the number and composition of image-forming layers, and the number and types of auxiliary layers included in the elements. In particular, photographic elements can be still films, motion picture films, x-ray films, graphic arts films, paper prints or microfiche. They also can be black-and-white elements, color elements adapted for use in a negative-positive process or color elements adapted for use in a reversal process.

More particularly, the present invention relates to a photographic or a thermally-processable imaging element consisting of a support, at least one light-or heat-sensitive imaging layer, a transparent magnetic recording layer, and at least one electrically-conductive layer. The electrically-conductive layer of this invention can be a subbing layer underlying a sensitized silver halide emulsion layer(s); a subbing layer underlying a transparent magnetic recording layer; an intermediate layer inserted between emulsion layers; an intermediate layer either overlying or underlying a pelloid in a multi-element curl control layer; an auxiliary layer or an outermost protective layer on either side of the support, in particular, a backing layer on the side of the support opposite to the emulsion layer(s) or a protective overcoat (topcoat) overlying the emulsion layer(s) or overlying an intermediate layer overlying the emulsion layer(s). In the case of thermally-processable imaging elements, the electrically-conductive layer can be a subbing layer underlying the imaging layer(s), a protective overcoat layer overlying an imaging layer or a backing layer underlying or overlying a magnetic recording layer.

The use of electrically-conductive metal antimonate colloidal particles in conductive layers for imaging elements, especially antistatic layers for silver halide photographic elements, is broadly claimed in U.S. Pat. No. 5,368,995. Metal antimonate compounds which are preferred for use in electrically-conductive layers in accordance with this invention have rutile or rutile-related crystallographic structures and stoichiometries represented by either Formula (I) or Formula (II) below:

$$M^{+2}Sb^{+5}{}_2O_6 \quad (I)$$

where $M^{+2}$=$Zn^{+2}$,$Ni^{+2}$,$Mg^{+2}$,$Fe^{+2}$,$Cu^{+2}$,$Mn^{+2}$,$Co^{+2}$ $$M^{+3}Sb^{+5}O_4 \quad (II)$$

where $M^{+3}$=$In^{+3}$,$Sc^{+3}$,$Cr^{+3}$,$Fe^{+3}$,$Ga^{+3}$

Several types of conductive metal antimonates (e.g., $M^{+2}$=$Zn^{+2}$; $M^{+3}$=$In^{+3}$) are commercially available from Nissan Chemical Industries, Ltd. in the form of an aqueous or organic solvent-based colloidal dispersion. Such materials can be prepared by the methods described in Japanese Kokai No. 06-219743. Alternatively, a method for preparing Formula (I) ($M^{+2}$=$Zn^{+2}$, $Ni^{+2}$, $Cu^{+2}$, $Fe^{+2}$, etc.) is taught in U.S. Pat. Nos. 4,169,104 and 4,110,247 wherein an aqueous solution of potassium antimonate (i.e., $KSb(OH)_6$) is treated with an aqueous solution of an appropriate soluble $M^{+2}$ metal salt (e.g., chloride, nitrate, sulfate, etc.) to form a gelatinous precipitate of the corresponding insoluble hydrate of Formula (I). These hydrated gels are isolated and then washed with water to remove excess potassium ions and salt anions. The washed gels can be peptized by treatment with an aqueous solution of organic base (e.g., triethanolamine, monoethanolamine, tripropanolamine, diethanolamine, quaternary ammonium hydroxides, etc.) at temperatures of 25°to 150° C. as taught in U.S. Pat. No. 4,589,997 for the preparation of colloidal antimony pentoxide sols. Additional methods used to prepare colloidal sols of metal antimony oxide compounds have been reported. A sol-gel process has been described by Westin and Nygren (J. Mater. Sci., 27, 1617–25(1992); J. Mater. Chem., 3,367-71(1993)) in which precursors of Formula (I) such as binary alkoxide complexes of antimony and a bivalent metal are hydrolyzed to give amorphous gels of agglomerated colloidal particles of hydrated Formula (I). Heat treatment of the hydrated gels at moderate temperatures (<800° C.) are reported to form anhydrous particles of Formula (I) of the same size as the colloidal particles in the gels. Further, colloidal particles of compound Formula (I) prepared by the methods described hereinabove can be made semiconductive through appropriate thermal treatment in a reducing or inert atmosphere. The preferred primary particle size for the metal antimonate particles is about 0.005 to 0.050 μm; more preferred is about 0.010 to 0.030 μm.

In one preferred embodiment of this invention, the electrically-conductive layer contains non-conductive metal-containing filler particles partially substituted for various amounts of conductive colloidal zinc antimonate ($M^{+2}$=$Zn^{+2}$) particles, all dispersed in a film-forming polymeric binder, such as gelatin or a polyurethane. A wide variety of suitable non-conductive metal-containing filler particles can be substituted for the conductive metal antimonate particles including metal oxides, natural clays, synthetic clays, proto-clays, (e.g., imogolites), clay-like minerals, zeolites, micas, and the like. In a preferred embodiment, the combination of conductive zinc antimonate particles and non-conductive colloidal metal oxide particles results in improved optical transparency, decreased color, decreased haze, and only slightly decreased conductivity at substantially lower dry weight coverages of conductive zinc antimonate particles. Although coated layers can be prepared containing only non-conductive filler particles that are electrically-conductive at ambient relative humidity (~50% R.H.) because of the presence of various ionic species used to electrostatically stabilize the colloidal metal oxide particle dispersions, such layers typically exhibit substantially lower surface conductivities at low relative humidities (<20% R.H.) and after photographic processing and thus are unsuitable for antistatic layers or electrodes for imaging elements.

Suitable non-conductive metal oxide particles including tin oxide, zinc oxide, antimony pentoxide, zinc antimonate, titania, zirconia, magnesia, yttria, ceria, germania, alumina, silica, alumina-modified silicas, and other surface-modified silicas prepared by various methods can be substituted for a substantial fraction (≦75%) of the zinc antimonate in antistatic coatings without appreciably degrading the conductivity of the conductive layer. A wide variety of suitable colloidal size (~0.002–0.050 μm) metal oxide particles are commercially available. For example, suitable aqueous dispersions of non-conductive colloidal tin oxide particles are available from Nalco Chemical Co. and PQ Corp./Nyacol Products under the tradenames 88SN123 and SN-15, respectively. Dispersions of colloidal non-conductive zinc oxide and antimony pentoxide are available from PQ Corp./Nyacol Products under the tradenames DP5370 and JL527S, respectively. Dispersions of colloidal silica are available from Dupont Chemical under the tradename Ludox (e.g., Ludox AM, Ludox SM, etc.). Dispersions of colloidal alumina, titania, yttria, and zirconia are available from various other manufacturers as well. Although other electronically-conductive donor-doped or oxygen-deficient metal oxide colloidal particles (e.g., antimony-doped tin oxide) can be substituted either alone or in combination with non-conductive metal oxides for the metal antimonate, substitution of conductive zinc antimonate by other conductive metal oxides fails to achieve one or more advantages of the present invention (i.e., less haze, greater optical transparency, less color). Preferred non-conductive colloidal metal oxide particles for conductive layers of this invention include tin oxide, silica, and alumina-modified silica.

Other suitable colloidal metal oxide filler materials include natural clays, such as kaolin, bentonite, and especially dispersible or delaminatable smectite clays such as montmorillonite, beidellite, hectorite, and saponite. Synthetic smectite clay materials such as a synthetic layered hydrous magnesium silicate which closely resembles the naturally occurring clay mineral hectorite in both composition and structure are preferred. Hectorite belongs to the class of clays and clay-related minerals known as "swellable" clays and is relatively rare and typically is contaminated with other minerals such as quartz or ionic species which are difficult to remove. A particularly preferred synthetic hectorite which is free from contaminants can be prepared under controlled conditions and is available commercially from Laporte Industries, Ltd. under the tradename "Laponite". The crystallographic structure of this synthetic hectorite can be described as a three-layer hydrous magnesium silicate. The central layer contains magnesium ions octahedrally coordinated by oxygen, hydroxyl or fluoride ions, wherein the magnesium ions can be partially substituted with suitable monovalent ions such as lithium, sodium, potassium, and/or vacancies. This central octahedrally coordinated layer is sandwiched between two other layers containing silicon ions tetrahedrally coordinated by oxygen ions. Individual hectorite clay particles can be readily swollen using deionized water and ultimately exfoliated to provide a stable aqueous dispersion of tiny platelets (smectites) with an average diameter of about 0.025–0.050 $\mu$m and an average thickness of about 0.001 $\mu$m known as a "sol". In the presence of alkali, alkaline earth or metal ions, electrostatic attractions between the individual platelets can produce various associative structures which exhibit extended ordering. Because of the readily reversible nature of the weak attractive forces, these structures can be easily broken and reformed, producing a highly thixotropic system exhibiting low viscosity under shear and a high yield value. Such a sol of synthetic hectorite platelets can be combined with a dispersion of a suitable polymeric film-forming binder and applied to a support to provide transparent layers which can be electrically-conductive at high clay to polymeric binder weight ratios and at relatively high relative humidity. Typically, such conductive layers are not suitable for use in photographic elements because the level of electrical conductivity provided is dependent on relative humidity and is substantially degraded by photographic processing. Further, at the high clay to binder weight ratios required to obtain adequate levels of conductivity, adhesion to the conductive layer can be poor. In addition, poor cohesion of such highly filled clay-containing conductive backing layers can result in unacceptable levels of dusting.

The ratio of the amount of conductive metal antimonate to polymeric binder in a conductive layer is one of the critical factors which influences the ultimate conductivity of that layer. If this ratio is too small, little or no antistatic property is exhibited. If the ratio is very large, adhesion between the conductive layer and the support or overlying layers can be diminished. The optimum ratio of conductive particles to binder can vary depending on the particle conductivity, particle size, binder type, total dry weight coverage or coating thickness, and the conductivity requirements. It is useful to express the fraction of zinc antimonate in the coated layer in terms of volume percent rather than weight percent since the densities of the components (i.e., filler particles and binders) can vary widely. The lowest volume percentage of zinc antimonate for which the layer is conductive is determined by the efficiency of conductive network formation by the metal antimonate particles which depends on such factors as particle size, particle-particle interactions, specific (volume) resistivity, type of polymeric binder, coating solvent(s), and additives (e.g., dispersing aids, colloid stabilizers, surfactants, coating aids, etc.) present as well as various other process-related factors, such as post-coating drying conditions. The fraction of conductive metal antimonate particles in the conductive layers of this invention that can be substituted by non-conductive filler particles depends primarily upon the type of binder, the weight density of the non-conductive filler particles, the total dry weight coverage as well as the required level of conductivity for the conductive layer. Other factors, such as the type of non-conductive filler particle and the strengths of various particle-particle interactions also can influence the extent of substitution. Further, substitution of metal antimonate particles in the conductive layers by non-conductive metal-containing filler particles in accordance with this invention can result in manufacturing cost savings for imaging elements incorporating such layers.

In one preferred embodiment with zinc antimonate as the conductive particle, a suitable range for the weight percent of zinc antimonate is from about 20 to 85% of the weight of the coated layer after drying. This corresponds to a volume percent of zinc antimonate in the conductive layer ranging from about 4 to 50%. A suitable range for the weight percent of conductive zinc antimonate particles substituted by non-conductive filler particles is from about 10 to 80% in order to realize fully the advantages of the present invention. However, this range is strongly dependent on the particular polymeric binder(s) used, the total particle to binder weight ratio, as well as the total dry coverage. For example, in the case of a soluble, hydrophilic binder such as gelatin, less than about 20% of the zinc antimonate can be substituted by non-conductive filler for a total dry coverage of less than 0.4 g/m$^2$ as described in co-pending U.S. Ser. No. 08/969,393 assigned to the same assignee as the present Application. In the case of an insoluble dispersed binder such as a polyurethane, over 50% of the zinc antimonate particles can be substituted by non-conductive filler particles. In addition, there is some variation in these ranges which is dependent on the particular type of non-conductive filler particle used. Thus, the conductive layer includes 10 to 75 volume percent of zinc antimonate, 2 to 45 volume percent of nonconductive filler particles and from 20 to 88 volume percent of the polymeric binder. The conductive layer preferably includes 10 to 50 volume percent of zinc antimonate, 5 to 45 volume percent of nonconductive filler particles and from 20 to 85 volume percent of the polymeric binder. The conductive layer most preferably includes 12 to 45 volume percent of zinc antimonate, 5 to 40 volume percent of nonconductive filler particles and from 20 to 83 volume percent of the polymeric binder.

Polymeric film-forming binders useful in conductive layers prepared by the method of this invention include: water-soluble, hydrophilic polymers such as gelatin, gelatin derivatives, maleic acid anhydride copolymers; cellulose derivatives such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamide, their derivatives and partially hydrolyzed products, vinyl polymers and copolymers such as polyvinyl acetate and polyacrylate acid ester; derivatives of the above polymers; and other synthresinsresins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, and olefins and aqueous dispersions of polyurethanes or polyesterionomers. Gelatin and gelatin derivatives, aqueous dispersed polyurethanes and polyesterionomers, and aqueous emulsions of vinylidene halide copolymers are preferred binders for conductive layers of this invention.

Solvents useful for preparing dispersions and coating formulations containing conductive metal antimonate particles and non-conductive filler particles include water; alcohols such as methanol, ethanol, propanol, isopropanol; ketones such as acetone, methylethyl ketone, and methylisobutyl ketone; esters such as methyl acetate, and ethyl acetate; glycol ethers such as methyl cellosolve, ethyl cellosolve; ethylene glycol, and mixtures thereof. Preferred solvents include water, alcohols, and acetone.

In addition to colloidal metal antimonate particles, colloidal non-conductive particles, one or more suitable film-forming polymeric binders, other components that are well known in the photographic art also can be included in conductive layers of this invention. Other typical addenda, such as matting agents, surfactants or coating aids, polymer lattices to improve dimensional stability, thickeners or viscosity modifiers, hardeners or cross-linking agents, soluble antistatic agents, soluble and/or solid particle dyes, antifoggants, lubricating agents, and various other conventional additives optionally can be present in any or all of the layers of the multilayer imaging element of this invention.

Colloidal dispersions of conductive metal antimonate particles and non-conductive filler particles in suitable liquid vehicles can be formulated with polymeric film-forming binders and various addenda and applied to a variety of supports to form the electrically-conductive layers of this invention. Such supports can be either transparent or opaque (reflective). Transparent film supports can be either colorless or colored by the addition of a dye or pigment. Transparent support materials used in the practice of this invention may be comprised of any of a wide variety of synthetic high molecular weight polymeric films such as cellulose esters including cellulose diacetate, cellulose triacetate, cellulose acetate butyrate, cellulose acetate propionate; cellulose nitrate; polyesters such as poly(ethylene terephthalate), poly (ethylene naphthalate) or poly(ethylene naphthalate) having included therein a portion of isophthalic acid, 1,4-cyclohexane dicarboxylic acid or 4,4-biphenyl dicarboxylic acid used in the preparation of the film support, polyesters wherein other glycols are employed such as, for example, cyclohexanedimethanol, 1,4-butanediol, diethylene glycol, polyethylene glycol; ionomers as described in U.S. Pat. No. 5,138,024, incorporated herein by reference, such as polyester ionomers prepared using a portion of the diacid in the form of 5-sodiosulfo-1,3-isophthalic acid or like ion containing monomers; polycarbonate; poly(vinyl acetal); polyolefins such as polyethylene, polypropylene; polystyrene; polyacrylates; and others; and blends or laminates of the above polymers. Of these film supports, cellulose triacetate, poly(ethylene terephthalate), and poly(ethylene naphthalate) prepared from 2,6-naphthalene dicarboxylic acids or derivatives thereof are preferred. Suitable opaque or reflective supports comprise paper, polymer-coated paper, including polyethylene-, polypropylene-, and ethylene-butylene copolymer-coated or laminated paper, synthetic papers, and pigment-containing polyesters and the like. The thickness of the support is not particularly critical. Support thicknesses of 2 to 10 mils (50 $\mu$m to 254 $\mu$m) are suitable for photographic elements in accordance with this invention. Photographic supports can be surface treated by various processes including corona discharge, glow discharge, UV exposure, flame treatment, e-beam treatment, and solvent washing or overcoated with adhesion promoting primer or tie layers containing polymers such as vinylidene chloride-containing copolymers, butadiene-based copolymers, glycidyl acrylate or methacrylate containing copolymers, maleic anhydride containing copolymers, and the like.

Dispersions containing colloidal conductive metal antimonate and non-conductive inorganic filler particles, a polymeric film-forming binder, and various additives in a suitable liquid vehicle can be applied to the aforementioned film or paper supports using any of a variety of well-known coating methods. Handcoating techniques include using a coating rod or knife or a doctor blade. Machine coating methods include air doctor coating, reverse roll coating, gravure coating, curtain coating, bead coating, slide hopper coating, extrusion coating, spin coating and the like, as well as other coating methods known in the art.

The electrically-conductive layer of this invention can be applied to the support at any suitable coverage depending on the specific requirements of a particular type of imaging element. For example, for silver halide photographic films, total dry weight coverages for conductive layers containing both conductive metal antimonate and non-conductive filler particles are preferably in the range of from about 0.01 to 2 g/m$^2$. More preferred dry coverages are in the range of about 0.05 to 1 g/m$^2$. The conductive layers of this invention typically exhibit a surface electrical resistivity (50% RH,20° C.) values of less than $1\times10^{11}$ ohms/square, preferably less than $1\times10^{10}$ ohms/square, and more preferably less than $1\times10^{9}$ ohms/square.

Imaging elements comprising a transparent magnetic recording layer are well known in the imaging art as described hereinabove. Such a transparent magnetic recording layer contains a polymeric film-forming binder, ferromagnetic particles, and other optional addenda for improved manufacturability or performance such as dispersants, coating aids, fluorinated surfactants, crosslinking agents or hardeners, catalysts, charge control agents, lubricants, abrasive particles, filler particles, and the like as described, for example, in Research Disclosure, Item No. 34390 (November, 1992).

Suitable ferromagnetic particles include ferromagnetic iron oxides, such as: $\gamma$-$Fe_2O_3$, $Fe_3O_4$; $\gamma$-$Fe_2O_3$ or $Fe_3O_4$ bulk-doped or surface-treated with Co, Zn, Ni or other metals; ferromagnetic chromium dioxides such as $CrO_2$ or CrO2 doped with Li, Na, Sn, Pb, Fe, Co, Ni, Zn or halogen atoms in solid solution; ferromagnetic transition metal ferrites; ferromagnetic hexagonal ferrites, such as barium and strontium ferrite; and ferromagnetic metal alloys with oxide coatings on their surface to improve chemical stability and/or dispersibility. In addition, ferromagnetic oxides with a shell of a lower refractive index particulate inorganic material or a polymeric material with a lower optical scattering cross-section as taught in U.S. Pat. Nos. 5,217,804 and 5,252,444 can be used. Suitable ferromagnetic particles exhibit a variety of sizes, shapes and aspect ratios. The preferred ferromagnetic particles for magnetic recording layers used in combination with the conductive layers of this invention are cobalt surface-treated γ-iron oxide with a specific surface area greater than 30 $m^2/g$.

As taught in U.S. Pat. No. 3,782,947, whether an element is useful for both photographic and magnetic recording depends on the size distribution and concentration of the ferromagnetic particles as well as the relationship between the granularities of the magnetic and the photographic layers. Generally, the coarser the grain of the silver halide emulsion in the photographic element containing a magnetic recording layer, the larger the mean size of the magnetic particles which are suitable can be. A magnetic particle coverage of from about 10 to 1000 $mg/m^2$, when uniformly distributed across the imaging area of a photographic imaging element, provides a magnetic recording layer that is suitably transparent to be useful for photographic imaging applications for particles with a maximum dimension of less than about 1 $\mu$m. Magnetic particle coverages less than about 10 $mg/m^2$ tend to be insufficient for magnetic recording purposes. Magnetic particle coverages greater than about 1000 $mg/m^2$ tend to produce magnetic recording layers with optical densities too high for photographic imaging. Particularly useful particle coverages are in the range of 20 to 70 $mg/m^2$. Coverages of about 20 $mg/m^2$ are particularly useful in magnetic recording layers for reversal films and coverages of about 40 $mg/m^2$ are particularly useful in magnetic recording layers for negative films. Magnetic particle concentrations of from about $1\times10^{-11}$ to $1\times10^{-10}$ $mg/\mu m^3$ are preferred for transparent magnetic recording layers prepared for use in accordance with this invention.

Suitable polymeric binders for use in the magnetic recording layer include, for example: vinyl chloride-based copolymers such as, vinyl chloride-vinyl acetate copolymers, vinyl chloride-vinyl acetate-vinyl alcohol terpolymers, vinyl chloride-vinyl acetate-maleic acid terpolymers, vinyl chloride-vinylidene chloride copolymers, vinyl chloride-acrylonitrile copolymers; acrylic ester-acrylonitrile copolymers, acrylic ester-vinylidene chloride copolymers, methacrylic ester- vinylidene chloride copolymers, methacrylic ester-styrene copolymers, thermoplastic polyurethane resins, phenoxy resins, polyvinyl fluoride, vinylidene chloride- acrylonitrile copolymers, butadiene-acrylonitrile copolymers, acrylonitrile- butadiene-acrylic acid terpolymers, acrylonitrile-butadiene-methacrylic acid terpolymers, polyvinyl butyral, polyvinyl acetal, cellulose derivatives such as cellulose esters including cellulose acetate, cellulose diacetate, cellulose triacetate, cellulose acetate butyrate, cellulose acetate propionate; and styrene-butadiene copolymers, polyester resins, phenolic resins, thermosetting polyurethane resins, melamine resins, alkyl resins, urea-formaldehyde resins and the like. Preferred binders for organic solvent-coated transparent magnetic recording layers are polyurethanes, vinyl chloride-based copolymers, and cellulose esters, particularly cellulose diacetate and cellulose triacetate.

Binders for transparent magnetic recording layers also can be film-forming hydrophilic polymers such as water soluble polymers, cellulose ethers, latex polymers and water-dispersible polyesters as described in *Research Disclosures* No. 17643 and 18716 and U.S. Pat. Nos. 5,147,768; 5,457,012; 5,520,954, and 5,531,913. Suitable water-soluble polymers include gelatin, gelatin derivatives, casein, agar, starch, polyvinyl alcohol, acrylic acid copolymers, and maleic acid anhydride. Suitable cellulose ethers include carboxymethyl cellulose and hydroxyethyl cellulose. Other suitable aqueous binders include aqueous lattices of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl chloride copolymers and vinylidene chloride copolymers, and butadiene copolymers and aqueous dispersions of polyurethanes or polyesterionomers. Preferred hydrophilic binders include gelatin, gelatin derivatives, and combinations of gelatin with a polymeric cobinder. Preferred gelatins include any alkali- or acid-treated gelatins.

The binder in the magnetic recording layer can be optionally cross-linked. Binders which contain active hydrogen atoms including —OH, —$NH_2$,— NHR, where R is an organic radical, and the like, can be crosslinked using an isocyanate or polyisocyanate as described in U.S. Pat. No. 3,479,310. Suitable polyisocyanates include: tetramethylene diisocyanate, hexamethylene diisocyanate, diisocyanato dimethylcyclohexane, dicyclohexylmethane diisocyanate, isophorone diisocyanate, dimethylbenzene diisocyanate, methylcyclohexylene diisocyanate, lysine diisocyanate, tolylene diisocyanate, diphenylmethane diisocyanate, and polymers thereof; polyisocyanates prepared by reacting an excess of an organic diisocyanate with an active hydrogen-containing compounds such as polyols, polyethers and polyesters and the like, including ethylene glycol, propylene glycol, dipropylene glycol, butylene glycol, trimethylol propane, hexanetriol, glycerine sorbitol, pentaerythritol, castor oil, ethylenediamine, hexamethylenediamine, ethanolamine, diethanolamine, triethanolamine, water, ammonia, urea, and the like, including biuret compounds, allophanate compounds, and the like. One preferred polyisocyanate crosslinking agent is the reaction product of trimethylol propane and 2,4-tolylene diisocyanate sold by Mobay under the tradename Mondur CB 75.

Further, hydrophilic binders can be hardened using any of a variety of methods known to one skilled in the art. Useful hardening agents include aldehyde compounds such as formaldehyde, ketone compounds, isocyanates, aziridine compounds, epoxy compounds, chrome alum, zirconium sulfate, and the like.

Examples of suitable solvents for coating the magnetic recording layer include: water; ketones, such as acetone, methyl ethyl ketone, methylisobutyl ketone, and cyclohexanone; alcohols, such as methanol, ethanol, isopropanol, and butanol; esters such as ethyl acetate and butyl acetate, ethers; aromatic solvents, such as toluene; and chlorinated hydrocarbons, such as carbon tetrachloride, chloroform, dichloromethane; trichloromethane, trichloroethane, tetrahydrofuran; glycol ethers such as ethylene glycol monomethyl ether, and propylene glycol monomethyl ether; and ketoesters, such as methylacetoacetate. Optionally, due to the requirements of binder solubility, magnetic dispersibility and coating rheology, a mixture of solvents may be advantageous. One preferred solvent mixture consists of a chlorinated hydrocarbon, ketone and/or alcohol, and ketoesters. Another preferred solvent mixture consists of a chlorinated hydrocarbon, ketone and/or alcohols, and a glycol ether. Other preferred solvent mixtures include dichloromethane, acetone and/or methanol, methylacetoacetate;

dichloromethane, acetone and/or methanol, propylene glycol monomethyl ether; and methylethyl ketone, cyclohexanone and/or toluene. For hydrophilic binders and water-soluble binders, such as gelatin, water is the preferred solvent.

As indicated hereinabove, the magnetic recording layer also can contain additional optional components such as dispersing agents, wetting agents, surfactants or fluorinated surfactants, coating aids, viscosity modifiers, soluble and/or solid particle dyes, antifoggants, matte particles, lubricants, abrasive particles, filler particles, antistatic agents, and other addenda that are well known in the photographic and magnetic recording arts.

The transparent magnetic recording layer can be positioned in an imaging element in any of various positions. For example, it can overlie one or more image-forming layers, or underlie one or more image forming layers, or be interposed between image-forming layers, or be coated on the side of the support opposite to an image-forming layer. In a silver halide photographic element, the transparent magnetic layer is preferably on the side of the support opposite the silver halide emulsion. A typical thickness for the magnetic recording layer is in the range from about 0.05 to 10 $\mu$m.

Conductive layers of this invention can be incorporated into multilayer imaging elements in any of various configurations depending upon the requirements of the specific imaging element. The conductive layer of this invention is located preferably on the same side of the support as the magnetic layer as a subbing or tie layer underlying the magnetic layer or as a topcoat layer overlying the magnetic layer. Alternatively, the function of the conductive layer can be incorporated into the magnetic layer as described in U.S. Pat. Nos. 5,427,900 and 5,459,021. This function can be accomplished more effectively by introducing both the conductive metal antimonate particles and non-conductive filler particles of this invention in combination with ferromagnetic particles in suitable concentrations and proportions into a single electrically-conductive transparent magnetic recording layer. Optional additional conductive layers also can be located on the same side of the support as the imaging layer(s) or on both sides of the support. Another conductive subbing layer can be applied either under or over a gelatin subbing layer containing an annihilation dye or pigment. Alternatively, both annihilation and antistatic functions can be combined in a single layer containing conductive particles, annihilation dye, and a binder. Such a hybrid layer is typically coated on the same side of the support as the sensitized emulsion layer. Additional optional layers can be present as well. Further, an optional conductive layer can be used as an outermost layer of an imaging element, for example, as a protective layer overlying an image-forming layer. When a conductive layer is applied over a sensitized emulsion layer, it is not necessary to apply any intermediate layers such as barrier or adhesion-promoting layers between the conductive overcoat layer and the imaging layer(s), although they can optionally be present. Other addenda, such as polymer lattices to improve dimensional stability, hardeners or cross-linking agents, surfactants, matting agents, lubricants, and various other well-known additives can be present in any or all of the above mentioned layers.

Conductive layers of this invention underlying a transparent magnetic recording layer typically exhibit an internal resistivity of less than $1\times10^{11}$ ohms/square, preferably less than $1\times10^{10}$ ohms/square, and more preferably, less than $1\times10^{9}$ ohms/square.

The imaging elements of this invention can be of many different types depending on the particular use for which they are intended. Such imaging elements include, for example, photographic, thermographic, electrothermographic, photothermographic, dielectric recording, dye migration, laser dye-ablation, thermal dye transfer, electrostatographic, electrophotographic imaging elements, and others described hereinabove. Suitable photosensitive image-forming layers are those which provide color or black and white images. Such photosensitive layers can be image-forming layers containing silver halides such as silver chloride, silver bromide, silver bromoiodide, silver chlorobromide and the like. Both negative and reversal silver halide elements are contemplated. For reversal films, the emulsion layers described in U.S. Pat. No. 5,236,817, especially Examples 16 and 21, are particularly suitable. Any of the known silver halide emulsion layers, such as those described in *Research Disclosure,* Vol. 176, Item 17643 (December, 1978), *Research Disclosure*, Vol. 225, Item 22534 (January, 1983), *Research Disclosure*, Item 36544 (September, 1994), and *Research Disclosure*, Item 37038 (February, 1995) and the references cited therein are useful in preparing photographic elements in accordance with this invention.

In a particularly preferred embodiment, imaging elements comprising the electrically-conductive layers of this invention are photographic elements which can differ widely in structure and composition. For example, said photographic elements can vary greatly with regard to the type of support, the number and composition of the image-forming layers, and the number and types of auxiliary layers that are included in the elements. In particular, photographic elements can be still films, motion picture films, x-ray films, graphic arts films, paper prints or microfiche. It is also specifically contemplated to use the conductive layer of the present invention in small format films as described in *Research Disclosure*, Item 36230 (June, 1994). Photographic elements can be either simple black-and-white or monochrome elements or multilayer and/or multicolor elements adapted for use in a negative-positive process or a reversal process. Generally, the photographic element is prepared by coating one side of the film support with one or more layers comprising a dispersion of silver halide crystals in an aqueous solution of gelatin and optionally one or more subbing layers. The coating process can be carried out on a continuously operating coating machine wherein a single layer or a plurality of layers are applied to the support. For multicolor elements, layers can be coated simultaneously on the composite film support as described in U.S. Pat. Nos. 2,761,791 and 3,508,947. Additional useful coating and drying procedures are described in *Research Disclosure*, Vol. 176, Item 17643 (Dec., 1978).

Imaging elements incorporating conductive layers in combination with a transparent magnetic recording layer in accordance with this invention also can contain additional layers including adhesion-promoting layers, lubricant or transport-controlling layers, hydrophobic barrier layers, annihilation layers, abrasion and scratch protection layers, and other special function layers. Imaging elements in accordance with this invention incorporating a conductive layer in combination with a transparent magnetic recording layer useful for specific imaging applications such as color negative films, color reversal films, black-and-white films, color and black-and-white papers, electrographic media, dielectric recording media, thermally processable imaging elements, thermal dye transfer recording media, laser ablation media, and other imaging applications should be readily apparent to those skilled in photographic and other imaging arts.

The present invention is illustrated by the following detailed examples of its practice. However, the scope of this invention is by no means restricted to these illustrative examples.

EXAMPLES 1–3

Aqueous antistatic coating formulations containing colloidal conductive zinc antimonate particles with an average primary particle size of 0.015 to 0.030 μm (by BET), colloidal synthetic hectorite clay particles with an average platelet size of about 0.025 μm in diameter and about 0.001 μm in thickness (by TEM), aqueous dispersed polyurethane binder, and various other additives described below were prepared at nominally 3.1% total solids by weight. The weight ratios of zinc antimonate to synthetic clay to polyurethane binder were nominally 55:15:30, 45:25:30, and 40:20:40 for the conductive layers of Examples 1, 2, and 3, respectively. These ratios expressed in terms of volume percents are given in Table 1. The coating formulations are given below:

| | Weight % (wet) | | |
|---|---|---|---|
| Component | Ex. 1 | Ex. 2 | Ex. 3 |
| $ZnSb_2O_6$[1] | 1.681 | 1.375 | 1.223 |
| Clay[2] | 0.458 | 0.764 | 0.610 |
| Polyurethane[3] | 0.917 | 0.917 | 1.222 |
| Wetting aid[4] | 0.033 | 0.033 | 0.033 |
| Deionized water | 96.911 | 96.911 | 96.912 |

[1]CELNAX CX-Z, Nissan Chemical Ind.
[2]Laponite RDS, Laporte Industries Ltd.
[3]Witcobond W-236, Witco Chemical
[4]Triton X-100, Rohm & Haas The above coating formulations were applied to a moving web of 4 mil (100 μm) thick poly(ethylene terephthalate) film support using a coating hopper so as to provide nominal total dry coverages of 1 g/m$^2$ (Examples 1a, 2a, 3a), 0.6 g/m$^2$ (Examples 1b, 2b, 3b), and 0.3 g/m$^2$ (Example 1c). The film support had been coated previously with a typical primer layer consisting of a terpolymer latex of acrylonitrile, vinylidene chloride, and acrylic acid.

Surface electrical resistivity (SER) of the conductive layers was measured at nominally 20° C. and 50% relative humidity using a two-point DC electrode method similar to that described in U.S. Pat. No. 2,801,191. For adequate antistatic performance, conductive layers with SER values of 10 log ohms/square or less are preferred.

The optical and ultraviolet transparency of the conductive layers prepared as described herein were evaluated. Total optical (ortho) and ultraviolet densities ($D_{min}$) were evaluated at 530 nm and 380 nm, respectively, using a X-Rite Model 361T transmission densitometer. Net or ΔUV $D_{min}$ and net or ΔOrtho $D_{min}$ values were calculated by correcting the total ultraviolet and optical densities for contributions from the support. Surface resistivity values and net ultraviolet and optical densities are given in Table 1.

EXAMPLES 4–6

Aqueous antistatic coating formulations containing colloidal conductive zinc antimonate particles with an average primary particle size of 0.015 to 0.030 μm (by BET), colloidal tin oxide particles with an average primary particle size of about 0.015 μm, aqueous dispersed polyurethane binder, and various other additives described below were prepared at nominally 2.9% total solids by weight. The weight ratios of zinc antimonate to tin oxide to polyurethane binder were nominally 43.5:32.5:24, 33:54:13, and 22:59:19 for the conductive layers of Examples 4, 5, and 6, respectively. These ratios expressed in terms of volume percents are given in Table 1. The coating formulations are given below:

| | Weight % (wet) | | |
|---|---|---|---|
| Component | Ex. 4 | Ex. 5 | Ex. 6 |
| $ZnSb_2O_6$[1] | 1.268 | 0.940 | 0.626 |
| Colloidal tin oxide[2] | 0.962 | 1.568 | 1.741 |
| Polyurethane[3] | 0.693 | 0.376 | 0.537 |
| Wetting aid[4] | 0.026 | 0.022 | 0.021 |
| Deionized water | 97.051 | 97.094 | 97.075 |

[1]CELNAX CX-Z, Nissan Chemical Ind.
[2]SN-15, PQ Corporation, Nyacol Products
[3]Witcobond W-236, Witco Chemical
[4]Triton X-100, Rohm & Haas The above coating formulations were applied to a moving web of 4 mil (100 μm) thick poly(ethylene terephthalate) film support using a coating hopper so as to provide nominal total dry coverages of 1 g/m$^2$ (Examples 4a, 5a, 6a) and 0.6 g/m$^2$ (Examples 4b, 5b, 6b). The film support had been coated previously with a typical primer layer consisting of a terpolymer latex of acrylonitrile, vinylidene chloride, and acrylic acid.

EXAMPLES 7–9

Aqueous antistatic coating formulations containing colloidal conductive zinc antimonate particles with an average primary particle size of 0.015 to 0.030 μm (by BET), colloidal alumina-modified silica particles with an average primary particle size of about 0.007 μm, aqueous dispersed polyurethane binder, and various other additives described below were prepared at nominally 3.0% total solids by weight. The weight ratios of zinc antimonate to silica to polyurethane binder were nominally 56:13:31, 52:27:21, and 41.5:18:40.5 for the conductive layers of Examples 7, 8, and 9, respectively. These ratios expressed in terms of volume percents are given in Table 1. The coating formulations are given below:

| | Weight % (wet) | | |
|---|---|---|---|
| Component | Ex. 7 | Ex. 8 | Ex. 9 |
| $ZnSb_2O_6$[1] | 1.675 | 1.555 | 1.251 |
| Colloidal silica[2] | 0.402 | 0.821 | 0.550 |
| Polyurethane[3] | 0.915 | 0.622 | 1.251 |
| Wetting aid[4] | 0.034 | 0.034 | 0.034 |
| Deionized water | 96.974 | 96.968 | 96.91 |

[1]CELNAX CX-Z, Nissan Chemical Ind.
[2]LUDOX AM, Dupont Chemicals
[3]Witcobond W-236, Witco Chemical
[4]Triton X-100, Rohm & Haas The above coating formulations were applied to a moving web of 4 mil (100 μm) thick poly(ethylene terephthalate) film support using a coating hopper so as to provide nominal total dry coverages of 1 g/m$^2$ (Examples 7a, 8a, 9a) and 0.6 g/m$^2$ (Examples 7b, 8b, 9b). The film support had been coated previously with a typical primer layer consisting of a terpolymer latex of acrylonitrile, vinylidene chloride, and acrylic acid.

COMPARATIVE EXAMPLES 1–5

Aqueous antistatic coating formulations containing colloidal conductive zinc antimonate particles with an average primary particle size of 0.015 to 0.030 μm (by BET), aqueous dispersed polyurethane binder, and a wetting aid described below were prepared at nominally 3.0% total solids by weight. The weight ratios of zinc antimonate to polyurethane binder were nominally 70:30, 80:20, 50:50, 60:40, and 30:70 for the conductive layers of Comparative Examples 1, 2, 3, 4, and 5, respectively. These ratios are expressed in terms of volume percents in Table 1. The coating formulations are given below:

| | Weight % (wet) | | | | |
|---|---|---|---|---|---|
| Component | Comp. Ex. 1 | Comp. Ex. 2 | Comp. Ex. 3 | Comp. Ex. 4 | Comp. Ex. 5 |
| $ZnSb_2O_6$[1] | 2.139 | 2.399 | 1.499 | 1.833 | 0.917 |
| Polyurethane[2] | 0.917 | 0.600 | 1.500 | 1.222 | 2.139 |
| Wetting aid[3] | 0.033 | 0.033 | 0.033 | 0.033 | 0.033 |
| Deionized water | 96.911 | 96.968 | 96.968 | 96.912 | 96.911 |

[1]CELNAX CX-Z, Nissan Chemical Ind.
[2]Witcobond W-236, Witco Chemical
[3]Triton X-100, Rohm & Haas The above coating formulations were applied to a moving web of 4 mil (100 μm) thick poly(ethylene terephthalate) film support using a coating hopper so as to provide nominal total dry coverages of 1 g/m$^2$ (Comparative Examples 1a, 2a, 3a, 4a, 5) and 0.6 g/m$^2$ (Comparative Examples 1b, 2b, 3b, 4b). The film support had been coated previously with a typical primer layer consisting of a terpolymer latex of acrylonitrile, vinylidene chloride, and acrylic acid. Surface resistivity values and net ultraviolet and optical densities are given in Table 1.

COMPARATIVE EXAMPLE 6

Conductive layers containing colloidal synthetic hectorite clay particles with an average platelet size of about 0.025 μm in diameter and about 0.001 μm in thickness (by TEM), aqueous dispersed polyurethane binder, and various other additives were prepared as described in Example 2 except that the synthetic hectorite clay filler was substituted for all of the colloidal conductive zinc antimonate. The weight ratio of synthetic clay to polyurethane binder was nominally 70:30. The volume percent of clay was about 52%. Conductive layers were coated as described for Example 2 at nominal total dry coverages of I and 0.6 g/m$^2$ to provide the conductive layers of Comparative Examples 6a and 6b, respectively. Surface resistivity values and net ultraviolet and optical densities are given in Table 1.

TABLE 1

| Conductive layers containing polyurethane (Witcobond W-236) as film forming binder | | | | | | | | |
|---|---|---|---|---|---|---|---|---|
| Sample | % ZA[1] weight | % ZA[1] volume | % NCF[2] weight | % NCF[2] volume | Total Dry Coverage[3] | SER[4] @50% RH | Δ UV $D_{min}$ | Δ Ortho $D_{min}$ |
| Ex. 1a | 55 | 21 | 15 | 15 | 1 | 8.3 | 0.041 | 0.011 |
| Ex. 1b | 55 | 21 | 15 | 15 | 0.6 | 8.7 | 0.026 | 0.009 |
| Ex. 1c | 55 | 21 | 15 | 15 | 0.3 | 9.5 | 0.020 | 0.007 |
| Ex. 2a | 45 | 16 | 25 | 24 | 1 | 8.7 | 0.032 | 0.009 |
| Ex. 2b | 45 | 16 | 25 | 24 | 0.6 | 9.0 | 0.021 | 0.007 |
| Ex. 3a | 40 | 13 | 20 | 17 | 1 | 9.6 | 0.028 | 0.007 |
| Ex. 3b | 40 | 13 | 20 | 17 | 0.6 | 10.3 | 0.020 | 0.006 |
| Ex. 4a | 43.5 | 21 | 32.5 | 15 | 1 | 8.9 | 0.026 | 0.008 |
| Ex. 4b | 43.5 | 21 | 32.5 | 15 | 0.6 | 9.2 | 0.020 | 0.009 |
| Ex. 5a | 33 | 21 | 54 | 33 | 1 | 9.1 | 0.024 | 0.008 |
| Ex. 5b | 33 | 21 | 54 | 33 | 0.6 | 9.4 | 0.018 | 0.007 |
| Ex. 6a | 22 | 12 | 59 | 31 | 1 | 10.4 | 0.018 | 0.007 |
| Ex. 6b | 22 | 12 | 59 | 31 | 0.6 | 10.5 | 0.012 | 0.008 |
| Ex. 7a | 56 | 21 | 13 | 15 | 1 | 8.5 | 0.042 | 0.014 |
| Ex. 7b | 56 | 21 | 13 | 15 | 0.6 | 8.7 | 0.029 | 0.012 |
| Ex. 8a | 52 | 21 | 27 | 33 | 1 | 8.7 | 0.032 | 0.007 |
| Ex. 8b | 52 | 21 | 27 | 33 | 0.6 | 8.9 | 0.021 | 0.006 |
| Ex. 9a | 41.5 | 13 | 18 | 17 | 1 | 9.4 | 0.032 | 0.011 |
| Ex. 9b | 41.5 | 13 | 18 | 17 | 0.6 | 9.7 | 0.024 | 0.009 |
| Comp. Ex. 1a | 70 | 30 | 0 | 0 | 1 | 8.0 | 0.050 | 0.017 |
| Comp. Ex. 1b | 70 | 30 | 0 | 0 | 0.6 | 8.4 | 0.035 | 0.015 |
| Comp. Ex. 2a | 80 | 42 | 0 | 0 | 1 | 7.7 | 0.048 | 0.012 |
| Comp. Ex. 2b | 80 | 42 | 0 | 0 | 0.6 | 8.1 | 0.033 | 0.040 |
| Comp. Ex. 3a | 50 | 15 | 0 | 0 | 1 | 9.1 | 0.040 | 0.015 |
| Comp. Ex. 3b | 50 | 15 | 0 | 0 | 0.6 | 9.4 | 0.027 | 0.012 |
| Comp. Ex. 4a | 60 | 21 | 0 | 0 | 1 | 8.5 | 0.047 | 0.018 |
| Comp. Ex. 4b | 60 | 21 | 0 | 0 | 0.6 | 8.9 | 0.034 | 0.014 |
| Comp. Ex. 5 | 30 | 7 | 0 | 0 | 1 | 13.7 | 0.023 | 0.005 |
| Comp. Ex. 6a | 0 | 0 | 70 | 52 | 1 | 11.3 | 0.000 | 0.000 |
| Comp. Ex. 6b | 0 | 0 | 70 | 52 | 0.6 | 11.4 | 0.000 | 0.000 |

[1]ZA = zinc antimonate
[2]NCF = non-conductive filler particle (i.e., Laponite RDS clay; SN-15 tin oxide; LUDOX AM silica)
[3]Total Dry Coverage = g/m$^2$
[4]SER = log ohms/square The above Examples demonstrate that a substantial fraction of the zinc antimonate particles in conductive layers of this invention can be substituted by non-conductive metal-containing filler particles such as synthetic hectorite clay, colloidal tin oxide or colloidal silica surface-modified with alumina to give conductive layers with SER values comparable to those for layers containing higher weight fractions of unsubstituted zinc antimonate. More specifically, the substituted conductive layers of this invention exhibit comparable or only slightly higher (<1 log ohm/sq) SER values when coated at nominally equivalent total dry weight coverages (e.g., 0.3, 0.6, and 1 g/m$^2$) and constant weight ratios of total particles (i.e., zinc antimonate plus non-conductive filler) to binder (polyurethane) of 60:40 or greater, than unsubstituted layers containing higher weight percentages of zinc antimonate. Further, conductive layers containing nominally equivalent volume percentages of zinc antimonate exhibit comparable SER values in the presence of up to 30 volume percent of any of the non-conductive filler particles in accordance with this invention. For example, the SER values for the conductive layers of Examples 1, 4, 5, 7, and 8 containing nominally 21% zinc antimonate by volume (33 to 56% by weight), range from 8.3 to 9.1 log ohms/square for a total dry weight coverage of 1 g/m$^2$ and from 8.7 to 9.4 log ohms/square for a total dry weight coverage of 0.6 g/m$^2$. The conductive layers of Comparative Example 4 containing 21% unsubstituted zinc antimonate by volume (60% by weight) also exhibit SER values of 8.5 and 8.9 log ohms/square for total dry coverages of 1 and 0.6 g/m$^2$, respectively. Similarly, the conductive layers of Example 2 containing nominally 16% zinc antimonate by volume (45% by weight) exhibit SER values of 8.7 and 9.0 log ohms/square for total dry coverages of 1 and 0.6 g/m$^2$. The SER values for the conductive layers of Example 2 are somewhat lower than those for the conductive layers of Comparative Example 3 containing nominally 15% unsubstituted zinc antimonate by volume (50% by weight) for the same total dry coverages. Further, the SER values for the conductive layers of Examples 3 and 9 containing nominally 13% zinc antimonate by volume (40 and 56% by weight) were 9.4 and 9.6 log ohms/square, respectively, for a total dry coverage of 1 g/m$^2$ and 9.7 and 10.3 log ohms/square for a total dry coverage of 0.6 g/m$^2$. These SER values are comparable to those for the conductive layers of Comparative Example 3 containing 15% unsubstituted zinc antimonate by volume. Even at relatively low levels of zinc antimonate in the conductive layer, as in the conductive layers of Example 6 containing nominally 12% by volume zinc antimonate (22% by weight), SER values of 10.4 and 10.5 log ohms/square are obtained for total dry coverages of 1 g/m$^2$ and 0.6 g/m$^2$. However, at slightly lower volume percentages of zinc antimonate, as in the case of the layer of Comparative Example 5 containing only 7% zinc antimonate by volume (30% by weight), the amount of conductive particles is insufficient to form an effective conductive network and thus, the layer is not conductive. Further, the contribution of the metal-containing filler particles to the electrical conductivity of the conductive layers of this invention is insignificant relative to the metal antimonate particles as demonstrated by the SER of the conductive layer of Comparative Example 6 containing 52% synthetic clay filler by volume (70% by weight). Thus, the above results demonstrate that the level of conductivity of the conductive layers of this invention primarily depends on the volume fraction of zinc antimonate particles present in the layer rather than the weight fraction of zinc antimonate for layers coated at constant total dry weight coverages.

Because less zinc antimonate is present in the conductive layers of this invention as described hereinabove, the optical density and haze is substantially less for these layers than for conductive layers exhibiting comparable SER values coated at the same total dry coverages, but containing unsubstituted zinc antimonate particles. For example, the conductive layers of Examples 1a, 7a, 8a, and 4a all containing 21% zinc antimonate by volume (55, 56, 52, 43.5% by weight) with SER values of 8.3, 8.5, 8.7, and 8.9 log ohms/square respectively, have ΔUV $D_{min}$ and ΔOrtho $D_{min}$ in values which are substantially lower than those for the conductive layer of Comparative Example 4a which also contains 21% zinc antimonate by volume (60% by weight) and has a SER value of 8.5 log ohms/square. However, the ΔUV $D_{min}$ and ΔOrtho $D_{min}$ values of the layers of Examples 1a, 7a, and 8a are much closer to those of the layer of Comparative Example 3a containing only 15% zinc antimonate by volume (50% by weight) with a higher SER value of 9.1 log ohms/square. Further, the conductive layer of Example 5a which contains 21% zinc antimonate by volume (33% by weight) with a SER value of 9.1 log ohms/square exhibits ΔUV $D_{min}$ and ΔOrtho $D_{min}$ values which are nearly identical to those of the layer of Comparative Example 5 containing 30% zinc antimonate by weight (7% by volume) which is non-conductive. Although the SER values for the conductive layers of Examples 3a and 9a which contain 13% zinc antimonate by volume (40% and 41.5% by weight) are comparable to that of Comparative Example 3a, the ΔUV $D_{min}$ and ΔOrtho $D_{min}$ values are closer to those of the non-conductive layer of Comparative Example 5. Similarly, the conductive layer of Example 6a containing only 12% zinc antimonate by volume (22% by weight) with an SER value of 10.4 log ohms/square has ΔUV $D_{min}$ and ΔOrtho $D_{min}$ values which are nearly identical to those for the non-conductive layer of Comparative Example 5. Thus, the above results clearly demonstrate that the net UV and optical densities for the conductive layers of this invention depend mainly on the weight fraction of metal antimonate particles in the layer rather than volume fraction at constant total dry weight coverage. Furthermore, there appears to be little or no dependence on the type of non-conductive metal oxide filler particle used (e.g., synthetic clay, colloidal tin oxide or colloidal silica).

EXAMPLES 10–18

The conductive layers prepared in Examples 1–9 were overcoated with a transparent magnetic recording layer as described in *Research Disclosure*, Item 34390, November, 1992. The particular transparent magnetic recording layer employed contains cobalt surface-modified $\gamma$-$Fe_2O_3$ particles in a polymeric binder which optionally may be crosslinked and optionally may contain suitable abrasive particles. The polymeric binder consists of a blend of cellulose diacetate and cellulose triacetate. The binder was not crosslinked in the present examples. The magnetic recording layer was applied so as to provide a nominal total dry coverage of 1.5 g/m$^2$. An optional lubricant-containing topcoat layer comprising carnauba wax and a fluorinated surfactant as a wetting aid may be applied over the transparent magnetic recording layer to provide a nominal dry coverage of about 0.02 g/m$^2$. The resultant multilayer structure comprising an electrically-conductive antistatic layer overcoated with a transparent magnetic recording layer, an optional lubricant layer, and other additional optional layers is referred to herein as a "magnetic backing package."

The electrical performance of the magnetic backing package was evaluated by measuring the internal electrical resistivity of the conductive layer using a salt bridge wet electrode resistivity (WER) measurement technique (as described, for example, in "Resistivity Measurements on Buried Conductive Layers" by R. A. Elder, pages 251–254, 1990 EOS/ESD Symposium Proceedings). Typically, conductive layers with WER values greater than about 12 log ohm/square are considered to be ineffective at providing static protection for photographic imaging elements. WER values less than about 10 log ohm/square are preferred. In addition to WER values, the change in resistivity of the conductive layer after overcoating with the magnetic recording layer (ΔR=WER-SER) is also a measure of the robustness of the conductive network in the conductive layer. Rewetting of the surface of the conductive layer and penetration by coating solvent into the bulk of the conductive layer during the overcoating process can cause swelling and intermixing and result in decreased conductivity of the overcoated conductive layer. The magnitude of the observed change in resistivity of the conductive layer after overcoating can be influenced by binder selections for both layers, volume fraction of conductive particles in the conductive layer, total particle to binder volume ratio in the conductive layer, total dry coverage for both layers, solvent(s) used for coating the magnetic recording layer, drying conditions for both layers, and other process-related factors.

Dry adhesion of the magnetic backing package was evaluated by scribing a small cross-hatched region into the coating with a razor blade. A piece of high-tack adhesive tape was placed over the scribed region and quickly removed. The relative amount of coating removed is a qualitative measure of the dry adhesion.

Descriptions of the magnetic backing packages prepared using the conductive layers of Examples 1–9, the internal resistivity (WER) values, ΔR values, net ultraviolet and optical densities ($\Delta D_{min}$), and dry adhesion results are given in Table 2.

COMPARATIVE EXAMPLES 7–11

The conductive layers prepared in Comparative Examples 1–4 and 6 were overcoated with a transparent magnetic recording layer as described in *Research Disclosure,* Item 34390, November, 1992. The particular transparent magnetic recording layer employed contains cobalt surface-modified $\gamma$-$Fe_2O_3$ particles in a polymeric binder which optionally may be cross-linked and optionally may contain suitable abrasive particles. The polymeric binder consists of a blend of cellulose diacetate and cellulose triacetate. The binder was not crosslinked in the present examples. The magnetic recording layer was applied so as to provide a nominal total dry coverage of 1.5 g/m$^2$. An optional lubricant- containing topcoat layer comprising carnauba wax and a fluorinated surfactant as a wetting aid may be applied over the transparent magnetic recording layer to provide a nominal dry coverage of about 0.02 g/m$^2$. The resultant magnetic backing packages prepared using the conductive layers of Comparative Examples 1–4 and 6 were evaluated for internal resistivity (WER), ΔR, dry adhesion, and optical and ultraviolet densities ($D_{min}$) as described hereinabove with the results given in Table 2.

TABLE 2

Conductive layers overcoated with a transparent magnetic recording layer

| Sample | % ZA[1] weight | % ZA[1] volume | % NCF[2] weight | % NCF[2] volume | Total Dry Coverage[3] | WER[4] | Δ R[4] | Δ UV $D_{min}$ | Δ Ortho $D_{min}$ | Dry Adhesion |
|---|---|---|---|---|---|---|---|---|---|---|
| Ex. 10a | 55 | 21 | 15 | 15 | 1 | 8.9 | 0.3 | 0.208 | 0.071 | excellent |
| Ex. 10b | 55 | 21 | 15 | 15 | 0.6 | 9.3 | 0.6 | 0.191 | 0.069 | excellent |
| Ex. 10c | 55 | 21 | 15 | 15 | 0.3 | 10.3 | 0.8 | 0.186 | 0.006 | excellent |
| Ex. 11a | 45 | 16 | 25 | 24 | 1 | 9.1 | 0.4 | 0.201 | 0.070 | good |
| Ex. 11b | 45 | 16 | 25 | 24 | 0.6 | 9.5 | 0.5 | 0.192 | 0.067 | excellent |
| Ex. 12a | 40 | 13 | 20 | 17 | 1 | 9.9 | 0.3 | 0.203 | 0.071 | excetlent |
| Ex. 12b | 40 | 13 | 20 | 17 | 0.6 | 10.5 | 0.2 | 0.195 | 0.068 | excellent |
| Ex. 13a | 43.5 | 21 | 32.5 | 15 | 1 | 9.5 | 0.6 | 0.194 | 0.069 | excellent |
| Ex. 13b | 43.5 | 21 | 32.5 | 15 | 0.6 | 9.8 | 0.6 | 0.190 | 0.068 | excellent |
| Ex. 14a | 33 | 21 | 54 | 33 | 1 | 9.2 | −0.1 | 0.190 | 0.068 | excellent |
| Ex. 14b | 33 | 24 | 54 | 33 | 0.6 | 9.3 | 0.1 | 0.186 | 0.067 | excellent |
| Ex. 15a | 22 | 12 | 59 | 31 | 1 | 10.4 | 0.0 | 0.185 | 0.067 | excellent |
| Ex. 15b | 22 | 12 | 59 | 31 | 0.6 | 10.7 | 0.2 | 0.182 | 0.066 | excellent |
| Ex. 16a | 56 | 21 | 13 | 15 | 1 | 9.0 | 0.5 | 0.205 | 0.070 | excellent |
| Ex. 16b | 56 | 21 | 13 | 15 | 0.6 | 9.7 | 1.0 | 0.196 | 0.069 | excellent |
| Ex. 17a | 52 | 21 | 27 | 33 | 1 | 9.2 | 0.5 | 0.205 | 0.071 | excellent |
| Ex. 17b | 52 | 21 | 27 | 33 | 0.6 | 9.8 | 0.9 | 0.194 | 0.068 | excellent |
| Ex. 18a | 41 | 13 | 18 | 17 | 1 | 10.2 | 0.7 | 0.204 | 0.070 | excellent |
| Ex. 18b | 41 | 13 | 18 | 17 | 0.6 | 11.1 | 1.4 | 0.192 | 0.068 | excellent |
| Comp. Ex. 7a | 70 | 30 | 0 | 0 | 1 | 8.6 | 0.6 | 0.217 | 0.075 | excellent |
| Comp. Ex. 7b | 70 | 30 | 0 | 0 | 0.6 | 9.1 | 0.7 | 0.206 | 0.072 | excellent |
| Comp. Ex. 8a | 80 | 42 | 0 | 0 | 1 | 8.2 | 0.5 | 0.221 | 0.073 | excellent |
| Comp. Ex. 8b | 80 | 42 | 0 | 0 | 0.6 | 8.7 | 0.6 | 0.204 | 0.072 | excellent |
| Comp. Ex. 9a | 50 | 15 | 0 | 0 | 1 | 10.6 | 1.5 | 0.217 | 0.077 | excellent |
| Comp. Ex. 9b | 50 | 15 | 0 | 0 | 0.6 | 11.4 | 2.0 | 0.211 | 0.072 | excellent |
| Comp. Ex. 10a | 60 | 21 | 0 | 0 | 1 | 9.6 | 1.1 | 0.224 | 0.074 | excellent |
| Comp. Ex. 10b | 60 | 21 | 0 | 0 | 0.6 | 10.2 | 1.3 | 0.214 | 0.073 | excellent |
| Comp. Ex. 11a | 0 | 0 | 70 | 52 | 1 | >12.5 | >1.2 | 0.161 | 0.061 | poor |
| Comp. Ex. 11b | 0 | 0 | 70 | 52 | 0.6 | >12.5 | >1.1 | 0.169 | 0.061 | poor |

[1]ZA = zinc antimonate
[2]NCF = non-conductive filler particle (i.e., Laponite RDS clay; SN-15 tin oxide; LUDOX AM silica)
[3]Total Dry Weight Coverage = g/m$^2$
[4]WER and AR units = log ohms/square The change in layer resistivity, ΔR, for the conductive layers of Examples 10–18 and Comparative Examples 7–11 containing zinc antimonate after being overcoated by a transparent magnetic recording layer generally exhibits an increase as shown in Table 2. Such an increase in resistivity also has been reported in U.S. Pat. No. 5,457,013 for conductive layers containing less than about 85% unsubstituted zinc antimonate by weight (50% by volume). For the conductive layers of the present invention containing zinc antimonate partially substituted by non-conductive metal oxide particles, this increase is typically much less than that for conductive layers containing 70% or less by weight (30% by volume) unsubstituted zinc antimonate for the same total dry weight coverages. However, the magnitude of this increase in resistivity depends on the total volume fraction of particles (i.e., zinc antimonate plus non-conductive filler) present in the conductive layer. Therefore, at high volume fractions of particles (i.e., low volume fraction of polymeric binder), there is less swelling and intermixing resulting from decreased penetration of coating solvent into the bulk of the conductive layer during the overcoating process. For example, the conductive layer of Example 5a containing 21% zinc antimonate and 33% colloidal tin oxide filler by volume exhibits an increase in resistivity after overcoating of only 0.1 log ohm/square, whereas the conductive layer of Comparative Example 4a also containing 21% zinc antimonate by volume but no non-conductive filler exhibits an increase in resistivity after overcoating of 1.1 log ohm/square. Also, the conductive layer of Example 8a containing 21% zinc antimonate and 15% colloidal silica filler by volume exhibits an increase in resistivity after overcoating of only 0.5 log ohm/square. Similarly, the conductive layer of Example 3a containing 13% zinc antimonate and 17% synthetic clay filler by volume exhibits an increase in resistivity after overcoating of only 0.3 log ohm/square, whereas the conductive layer of Comparative Example 3a containing 15% zinc antimonate by volume and no non-conductive filler exhibits an increase in resistivity after overcoating of 1.5 log ohm/square. Furthermore, the presence of conductive zinc antimonate in the conductive layers of this invention is required since conductive layers of Comparative Example 6 containing 52% synthetic clay by volume and no zinc antimonate not only exhibit an increase in resistivity of greater than 1.2 log ohm/square but become essentially non-conductive after overcoating with magnetic layers (viz., Comparative Example 11).

The dry adhesion results in Table 2 for the conductive layers of this invention overcoated with a transparent magnetic recording layer (not crosslinked) are all good to excellent. However, poor dry adhesion is demonstrated by the conductive layers of Comparative Example 11 containing >50% synthetic clay by volume and no zinc antimonate. However, magnetic recording layers overlying clay-containing conductive layers generally can be crosslinked in order to improve the dry adhesion to acceptable levels.

The present invention has been described in detail with particular reference to certain preferred embodiments thereof, but it will be understood that variations and modifications can be effected within the spirit and scope of the invention.

What is claimed is:

1. A multilayer imaging element comprising:

a support;

at least one image-forming layer;

a transparent magnetic recording layer comprising magnetic particles dispersed in a first film-forming binder; and a transparent electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in second a film-forming binder.

2. The imaging element of claim 1, wherein the conductive metal antimonate particles comprise a volume percentage of from about 10 to 75% of the volume of said electrically-conductive layer.

3. The imaging element of claim 1, wherein the non-conductive metal-containing particles comprise a volume percentage of from 2 to 45 percent.

4. The imaging element of claim 1, wherein the binder comprises a volume percentage of from 20 to 88 percent.

5. The imaging element of claim 1, wherein the electrically conductive layer has a total dry weight coverage of from about 0.1 to about 10 $g/m^2$.

6. The imaging element of claim 1, wherein the average primary particle size of the electronically-conductive metal antimonate colloidal particles is from 0.015 μm to 0.03 μm.

7. The imaging element of claim 1, wherein the metal antimonate colloidal particles comprise:

$$M^{+2}Sb^{+5}{}_2O_6$$

wherein $M^{+2}$ is $Zn^{+2}$,$Ni^{+2}$,$Mg^{+2}$,$Fe^{+2}$,$Cu^{+2}$,$Mn^{+2}$, or $Co^{+2}$.

8. The imaging element of claim 1, wherein the metal antimonate colloidal particles comprise:

$$M^{+3}Sb^{+5}O_4$$

wherein $M^{+3}$ is $In^{+3}$,$Al^{+3}$,$Sc^{+3}$,$Cr^{+3}$,$Fe^{+3}$ or $Ga^{+3}$.

9. The imaging element of claim 1, wherein the metal antimonate colloidal particles comprise $ZnSb_2O_6$.

10. The imaging element of claim 1, wherein the metal antimonate colloidal particles comprise $InSbO_4$.

11. The imaging element of claim 1, wherein the non-conductive metal-containing colloidal particles comprise a metal oxide selected from the group consisting of tin oxide, zinc oxide, antimony pentoxide, germanium dioxide, titania, zirconia, alumina, silica, alumina-modified silica, magnesia, and zinc antimonate.

12. The imaging element of claim 1, wherein said non-conductive metal-containing colloidal particles comprise clay.

13. The imaging element of claim 10, wherein the clay is selected from the group consisting of kaolin, bentonite, montmorillonite, beiderite, hectorite and saponite.

14. The imaging element of claim 1, wherein the second film-forming binder comprises a water-soluble, hydrophilic polymer.

15. The imaging element of claim 1, wherein the second film-forming binder is selected from the group consisting of gelatin, cellulose derivative, organic solvent-soluble polymer, and water-dispersible, water-insoluble polymers.

16. The imaging element of claim 1, wherein said support is selected from the group consisting of poly(ethylene terephthalate) films, poly(ethylene naphthalate) films, cellulose acetate films, papers, and polymer-coated papers.

17. The imaging element as claimed in claim 1, wherein the magnetic particles comprise cobalt surface modified γ-iron oxide particles or magnetite particles.

18. The imaging element of claim 17, wherein the cobalt surface-modified γ-iron oxide particles or magnetite particles comprise a dry weight coverage of from 10 $mg/m^2$ to 1000 $mg/m^2$.

19. The imaging element of claim 17, wherein the cobalt surface-modified γ-iron oxide or magnetite particles comprise a dry weight coverage of from 20 $mg/m^2$ to 70 $mg/m^2$.

20. The imaging element of claim 1, wherein the first film-forming binder comprises cellulose acetate or polyurethane.

21. A photographic film comprising:

a support;

a silver halide emulsion layer superposed on a first side of said support;

an electrically-conductive layer superposed on a second side of said support; said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder; and a transparent magnetic recording layer overlying said electrically-conductive layer comprising magnetic particles dispersed in a film forming binder.

22. A photographic film comprising:

a support;

a first electrically-conductive layer superposed on a first side of said support said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder;

a silver halide emulsion layer superposed on said first electrically-conductive layer;

a second electrically-conductive layer superposed on a second side of said support said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder; and a transparent magnetic recording layer overlying said second electrically-conductive layer comprising magnetic particles dispersed in a film forming binder.

23. A photographic film comprising:

a support;

a silver halide emulsion layer superposed on a first side of said support;

a transparent magnetic recording layer superposed on a second side of said support comprising magnetic particles dispersed in a film forming binder; and an electrically-conductive layer superposed on said transparent magnetic recording layer; said electrically-conductive layer comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

24. A photographic film comprising:

a support;

a silver halide emulsion layer superposed on a first side of said support;

a conductive transparent magnetic recording layer superposed on a second side of said support comprising magnetic particles and electronically-conductive metal antimonate colloidal particles having a particle size of from 0.005 to 0.05 μm and non-conductive metal-containing colloidal particles having a particle size of from 0.002 to 0.05 μm dispersed in a film-forming binder.

25. A thermally-processable imaging element comprising:

a support;

a thermographic imaging layer superposed on a first side of said support;

an electrically-conductive layer superposed on a second side of said support comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder; and a transparent magnetic recording layer overlying said electrically-conductive layer comprising magnetic particles dispersed in a film-forming binder.

26. A thermally-processable imaging element comprising:

a support;

a first electrically-conductive layer superposed on a first side of said support comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder;

a thermographic imaging layer superposed on said first electrically-conductive layer;

a second electrically-conductive layer superposed on a second side of said support comprising electronically-conductive metal antimonate colloidal particles having a particle size of from 0.005 to 0.05 μm and non-conductive metal-containing colloidal particles having a particle size of from 0.002 to 0.05 μm dispersed in a film-forming binder a transparent magnetic recording layer superposed on said second electrically-conductive layer comprising magnetic particles dispersed in a film forming binder.

* * * * *